US007180591B1

(12) United States Patent
Moore et al.

(10) Patent No.: US 7,180,591 B1
(45) Date of Patent: Feb. 20, 2007

(54) SEMICONDUCTOR PROCESSORS, SENSORS, SEMICONDUCTOR PROCESSING SYSTEMS, SEMICONDUCTOR WORKPIECE PROCESSING METHODS, AND TURBIDITY MONITORING METHODS

(75) Inventors: Scott E. Moore, Meridian, ID (US); Scott G. Meikle, Boise, ID (US); Magdel Crum, Tucson, AZ (US)

(73) Assignee: Micron Technology, Inc, Boise, ID (US)

( * ) Notice: Subject to any disclaimer, the term of this patent is extended or adjusted under 35 U.S.C. 154(b) by 0 days.

(21) Appl. No.: 09/521,092

(22) Filed: Mar. 7, 2000

Related U.S. Application Data

(62) Division of application No. 09/324,737, filed on Jun. 3, 1999, now Pat. No. 6,290,576.

(51) Int. Cl.
*G01N 21/05* (2006.01)

(52) U.S. Cl. ..... 356/335; 356/339; 356/340

(58) Field of Classification Search ..... 451/41, 451/60, 285, 287, 6, 8, 36; 324/637, 639, 324/640, 642, 643; 356/432, 440, 364, 335, 356/342, 338, 339; 250/574; 68/12.02; 134/113; 435/288.7
See application file for complete search history.

(56) References Cited

U.S. PATENT DOCUMENTS 3,441,737 A 4/1969 Topol
3,612,688 A * 10/1971 Liskowitz ..... 356/342
3,653,767 A * 4/1972 Liskowitz ..... 356/336
3,695,763 A 10/1972 Shiuh
3,413,743 A 1/1973 Simms
4,152,070 A * 5/1979 Kushner et al. ..... 356/343
4,263,511 A * 4/1981 Hirschberg ..... 250/343
4,282,745 A 8/1981 Burr
4,320,978 A * 3/1982 Sato ..... 356/440
4,441,960 A * 4/1984 Karnis et al. ..... 162/49
4,457,624 A 7/1984 Goldberg et al.
4,730,922 A * 3/1988 Bach et al. ..... 356/73
4,874,243 A * 10/1989 Perren ..... 356/342
4,906,101 A * 3/1990 Lin et al. ..... 356/442
4,990,346 A 2/1991 Strippler et al.
5,059,811 A * 10/1991 King et al. ..... 250/573
5,085,831 A * 2/1992 Hickey et al. ..... 422/62
5,194,921 A 3/1993 Tambo et al.
5,446,531 A * 8/1995 Boyer et al. ..... 356/72
5,555,583 A * 9/1996 Berkcan ..... 8/158
5,653,624 A 8/1997 Ishikawa et al.
5,664,990 A 9/1997 Adams et al.
5,718,620 A 2/1998 Tanaka et al.

(Continued)

OTHER PUBLICATIONS

*The Science and Engineering of Microelectronic Fabrication; Campbell, Stephen A.; Oxford University Press*; 1996; pp. 253-257.

(Continued)

*Primary Examiner*—Jacob K. Ackun, Jr.
(74) *Attorney, Agent, or Firm*—Wells St. John, P.S.

(57) ABSTRACT

Semiconductor processors, sensors, semiconductor processing systems, semiconductor workpiece processing methods, and turbidity monitoring methods are provided. According to one aspect, a semiconductor processor includes a process chamber configured to receive a semiconductor workpiece for processing; a supply connection in fluid communication with the process chamber and configured to supply slurry to the process chamber; and a sensor configured to monitor the turbidity of the slurry. Another aspect provides a semiconductor workpiece processing method including providing a semiconductor process chamber; supplying slurry to the semiconductor process chamber; and monitoring the turbidity of the slurry using a sensor.

20 Claims, 6 Drawing Sheets

U.S. PATENT DOCUMENTS

| | | | | |
|---|---|---|---|---|
| 5,750,440 | A | 5/1998 | Vanell et al. | |
| 5,755,614 | A | 5/1998 | Adams et al. | |
| 5,791,970 | A | 8/1998 | Yueh | |
| 5,828,458 | A * | 10/1998 | Taylor et al. | |
| 5,836,805 | A | 11/1998 | Obeng | |
| 5,881,578 | A * | 3/1999 | Proppe et al. | |
| 5,885,134 | A | 3/1999 | Shibata et al. | |
| 5,912,737 | A * | 6/1999 | Bannerjee et al. | 356/364 |
| 5,923,433 | A | 7/1999 | Giuffre et al. | |
| 6,048,256 | A | 4/2000 | Obeng et al. | |
| 6,066,030 | A | 5/2000 | Uzoh | |
| 6,077,147 | A | 6/2000 | Yang et al. | |
| 6,096,185 | A | 8/2000 | Corlett et al. | |
| 6,099,386 | A | 8/2000 | Tsai et al. | |
| 6,100,976 | A * | 8/2000 | Ackerson | 356/336 |
| 6,136,043 | A | 10/2000 | Robinson et al. | |
| 6,159,082 | A | 12/2000 | Sugiyama et al. | |
| 6,165,048 | A | 12/2000 | Russ et al. | |
| 6,183,352 | B1 | 2/2001 | Kurisawa | |
| 6,184,983 | B1 * | 2/2001 | Yamaguchi et al. | 356/335 |
| 6,307,630 | B1 * | 10/2001 | Banerjee | 356/436 |
| 6,319,469 | B1 | 11/2001 | Mian et al. | |
| 6,379,538 | B1 | 4/2002 | Corlett et al. | |
| 6,409,936 | B1 * | 6/2002 | Robinson et al. | 252/79.1 |
| 6,482,325 | B1 | 11/2002 | Corlett et al. | |
| 6,567,166 | B2 * | 5/2003 | Ottens et al. | 356/343 |

OTHER PUBLICATIONS http://www.intratechnology.com/html/sensors.htm, Intra Technology, *Sensore*, Mar. 25, 1999, 2 pages.

http://www.ftsinc.com/complete/analite/analite.htm, FTS, *Analite-SDI Turbidity Sensor*, Mar. 25, 1999, 1 page.

http://www.customsensors.com/optimax.htm, Custom Sensors & Technology, *OptiMax 6000 Series Process Photometric Analyzers*, Mar. 25, 1999, 2 pages.

http://www.reflectronics.com/reflectronics_inc_contents.htm, Reflectronics, Inc., Fiber Optic Backscatter Sensor, Mar. 25, 1999, 1 page.

http://www.honeywell.com/sensing/prodinfo/turbidity/technical/turbidity.st, Gary O'Brien, Honeywell, *Turbidity Sensor for Electromechanical Dishwasher Control*, 1998-1999, 11 pages.

http://www.impomag.com/O_automa/1097O064.htm, ABB Instrumentation, The Stockroom, *Photodiode Sensor*, 1999, 1 page.

* cited by examiner

SEMICONDUCTOR PROCESSORS, SENSORS, SEMICONDUCTOR PROCESSING SYSTEMS, SEMICONDUCTOR WORKPIECE PROCESSING METHODS, AND TURBIDITY MONITORING METHODS

RELATED PATENT DATA

This patent resulted from a divisional application of U.S. patent application Ser. No. 09/324,737, filed Jun. 3, 1999, now U.S. Pat. No. 6,290,576, entitled "Semiconductor Processors, Sensors, and Semiconductor Processing Systems", naming Scott E. Moore et al. as inventors, the disclosure of which is incorporated by reference.

TECHNICAL FIELD

The present invention relates to semiconductor processors, sensors, semiconductor processing systems, semiconductor workpiece processing methods, and turbidity monitoring methods.

BACKGROUND OF THE INVENTION

Numerous semiconductor processing tools are typically utilized during the fabrication of semiconductor devices. One such common semiconductor processor is a chemical-mechanical polishing (CMP) processor. A chemical-mechanical polishing processor is typically used to polish or planarize the front face or device side of a semiconductor wafer. Numerous polishing steps utilizing the chemical-mechanical polishing system can be implemented during the fabrication or processing of a single wafer.

In an exemplary chemical-mechanical polishing apparatus, a semiconductor wafer is rotated against a rotating polishing pad while an abrasive and chemically reactive solution, also referred to as a slurry, is supplied to the rotating pad. Further details of chemical-mechanical polishing are described in U.S. Pat. No. 5,755,614, incorporated herein by reference.

A number of polishing parameters affect the processing of a semiconductor wafer. Exemplary polishing parameters of a semiconductor wafer include downward pressure upon a semiconductor wafer, rotational speed of a carrier, speed of a polishing pad, flow rate of slurry, and pH of the slurry.

Slurries used for chemical-mechanical polishing may be divided into three categories including silicon polish slurries, oxide polish slurries and metals polish slurries. A silicon polish slurry is designed to polish and planarize bare silicon wafers. The silicon polish slurry can include a proportion of particles in a slurry typically with a range from 1–15 percent by weight.

An oxide polish slurry may be utilized for polishing and planarization of a dielectric layer formed upon a semiconductor wafer. Oxide polish slurries typically have a proportion of particles in the slurry within a range of 1–15 percent by weight. Conductive layers upon a semiconductor wafer may be polished and planarized using chemical-mechanical polishing and a metals polish slurry. A proportion of particles in a metals polish slurry may be within a range of 1–5 percent by weight.

It has been observed that slurries can undergo chemical changes during polishing processes. Such changes can include composition and pH, for example. Furthermore, polishing can produce stray particles from the semiconductor wafer, pad material or elsewhere. Polishing may be adversely affected once these by-products reach a sufficient concentration. Thereafter, the slurry is typically removed from the chemical-mechanical polishing processing tool.

It is important to know the status of a slurry being utilized to process semiconductor wafers inasmuch as the performance of a semiconductor processor is greatly impacted by the slurry. Such information can indicate proper times for flushing or draining the currently used slurry.

SUMMARY OF THE INVENTION

The present invention provides semiconductor processors, sensors, semiconductor processing systems, semiconductor workpiece processing methods, and turbidity monitoring methods.

According to one aspect of the invention, a semiconductor processor is provided. The semiconductor processor includes a process chamber and a supply connection configured to provide slurry to the process chamber. A sensor is provided to monitor turbidity of the slurry. One embodiment of the sensor is configured to emit electromagnetic energy towards the supply connection providing the slurry. The supply connection is one of transparent and translucent in one embodiment. The sensor includes a receiver in the described embodiment configured to receive at least some of the emitted electromagnetic energy and to generate a signal indicative of turbidity responsive to the received electromagnetic energy.

In another arrangement, plural sensors are provided to monitor the turbidity of a subject material, such as slurry, at different corresponding positions. In addition, one or more sensors can be provided to monitor turbidity of a subject material within a horizontally oriented supply connection or container, a vertically oriented supply connection or container, or supply connections or containers in other orientations.

One sensor configuration of the invention provides a source configured to emit electromagnetic energy towards the supply connection. The sensor additionally includes plural receivers. One receiver is positioned to receive electromagnetic energy passing through the subject material and configured to output a feedback signal indicative of the received electromagnetic energy. The source is configured to adjust the intensity of emitted electromagnetic energy to provide a substantially constant amount of electromagnetic energy at the receiver. Another receiver is provided to monitor the emission of electromagnetic energy from the source and provide a signal indicative of turbidity.

The invention also includes other aspects including methodical aspects and other structural aspects as described below.

BRIEF DESCRIPTION OF THE DRAWINGS

Preferred embodiments of the invention are described below with reference to the following accompanying drawings.

FIG. 9 is a schematic diagram illustrating circuitry of the sensor configuration shown in FIG. 6.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
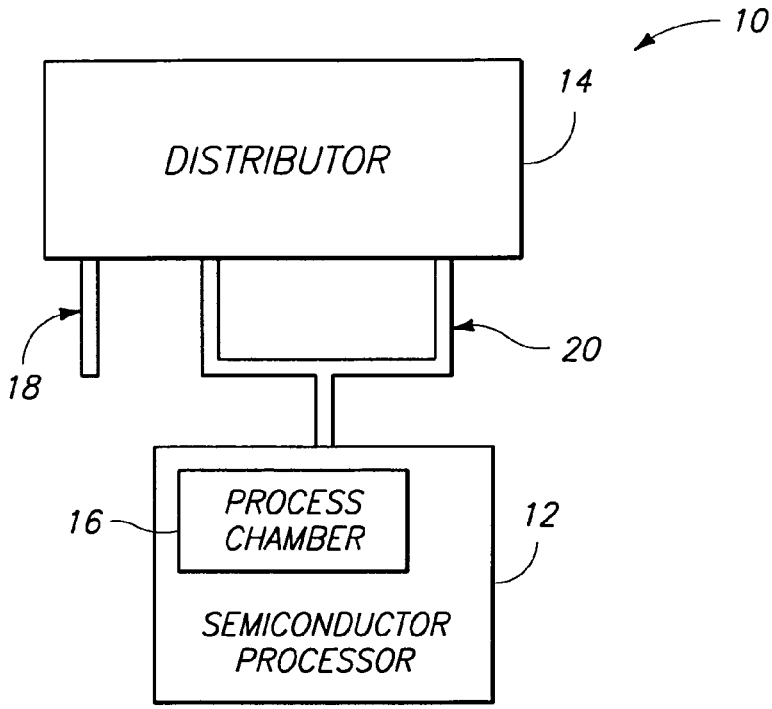
FIG. 1 is an illustrative representation of a slurry distributor and semiconductor processor.

Referring to FIG. 1, a semiconductor processing system 10 is illustrated. The depicted semiconductor processing system 10 includes a semiconductor processor 12 coupled with a distributor 14. Semiconductor processor 12 includes a process chamber 16 configured to receive a semiconductor workpiece, such as a silicon wafer. In an exemplary configuration, semiconductor processor 12 is implemented as a chemical-mechanical polishing processing tool.

Distributor 14 is configured to supply a subject material for use in semiconductor workpiece processing operations. For example, distributor 14 can supply a subject material comprising a slurry to semiconductor processor 12 for chemical-mechanical polishing applications.

Exemplary conduits or piping of semiconductor processing system 10 are shown in FIG. 1. In the depicted configuration, a static route 18 and a dynamic route 20 are provided. Further details of static route 18 and dynamic route 20 are described below with reference to FIGS. 2 and 3, respectively. In general, static route 18 is utilized to provide monitoring of the subject material of distributor 14 in a substantially static state. Such provides real-time information regarding the subject material being utilized within semiconductor processing system 10. Dynamic route 20 comprises a recirculation and distribution line in one configuration. In addition, subject material can be supplied 2 to semiconductor processor 12 via dynamic route 20.

Distributor 14 can include an internal recirculation pump (not shown) to periodically recirculate subject material through dynamic route 20. Subject material having particulate matter, such as a slurry, experiences gravity separation over time. Separation of such particulate matter of the slurry is undesirable. For example, the particulate matter may settle in areas of piping, valves or other areas of a supply line which are difficult to reach and clean. Further, some particulate matter may be extremely difficult to resuspend once it has settled over a sufficient period of time. Accordingly, it is desirable to monitor turbidity (percent solids within a liquid) of the subject material to enable reduction or minimization of excessive settling.

Figure 2:
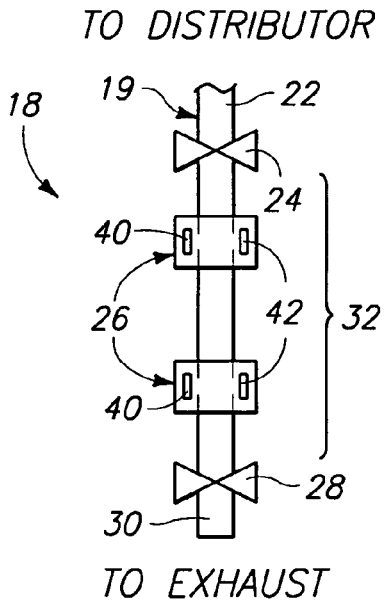
FIG. 2 is an illustrative representation of an exemplary arrangement for monitoring a static slurry.

Referring to FIG. 2, details of an exemplary static route 18 coupled with distributor 14 are illustrated. Static route 18 includes an elongated tube or pipe 19 for receiving subject material from distributor 14. In a preferred embodiment, pipe 19 comprises a transparent or translucent material, such as a transparent or translucent plastic. Static route 18 is coupled with distributor 14 at an intake end 22 of pipe 19. Piping hardware provided within the depicted static route 18 includes an intake valve 24, sensors 26 and an exhaust valve 28. Exhaust valve 28 is adjacent an exhaust end 30 of static route 18.

Valves 24, 28 can be selectively controlled to provide monitoring of the subject material of distributor 14 in a substantially static state. For example, with exhaust valve 28 in a closed state, intake valve 24 may be selectively opened to permit the entry of subject material within an intermediate container 32. Container 32 can be defined as the portion of static route 18 intermediate intake valve 24 and exhaust valve 28 in the described configuration. In typical operations, intake valve 24 is sealed or closed following entry of subject material into container 32. In the depicted arrangement, static route 18 is provided in a substantially vertical orientation. Static route 18 using valves 24, 28 and container 32 is configured to provide received subject material in a substantially static state (e.g., the subject material is not in a flowing state).

Plural sensors 26 are provided at predefined positions relative to container 32 as shown. Sensors 26 are configured to monitor the opaqueness or turbidity of subject material received within static route 18. In one configuration, plural sensors 26 are provided at different vertical positions to provide monitoring of the turbidity of the subject material within container 32 at corresponding different desired vertical positions of container 32. Such can be utilized to provide differential information between the sensors 26 to indicate small changes in slurry settling.

As described in further detail below, individual sensors include a source 40 and a receiver 42. In one configuration, source 40 is configured to emit electromagnetic energy towards container 32. Receiver 42 is configured and positioned to receive at least some of the electromagnetic energy. As described above, pipe 19 can comprise a transparent or translucent material permitting passage of electromagnetic energy. Sensors 26 can output signals indicative of the turbidity at the corresponding vertical positions of container 32 responsive to sensing operations.

It is desirable to provide plural sensors 26 in some configurations to monitor settling of particulate material (precipitation rates) over time within the subject material at plural vertical positions. Monitoring a substantially static subject material provides numerous benefits. Utilizing one or more sensors 26, the rate of separation can be monitored providing information regarding the condition of the subject material or slurry (e.g., testing and quantifying characteristics of a CMP slurry).

Properties of the subject material can be derived from the monitoring including, for example, how well particulate matter is suspended, adequate mixing, amount of or effectiveness of surfactant additives, the approximate size of the particulate matter, agglomeration of particulate matter, slurry age or lifetime, and likelihood of slurry causing defects. Such monitoring of settling rates can indicate when to change or drain a slurry being applied to semiconductor processor 12 to avoid degradation in processing performance, such as polishing performance within a chemical-mechanical polishing processor.

Subject material within container 32 may be drained via exhaust valve 28 following monitoring of the subject material. Exhaust end 30 of static route 18 can be coupled with a recovery system for direction back to distributor 14, or to a drain if the subject material will not be reused.

Figure 3:
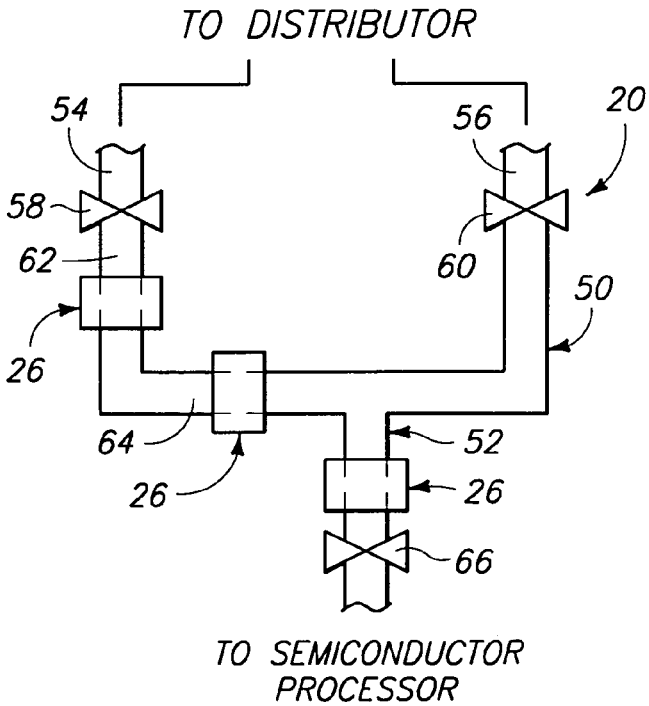
FIG. 3 is an illustrative representation of an exemplary arrangement for monitoring a dynamic slurry.

Referring to FIG. 3, details of dynamic route 20 are described. Dynamic route 20 comprises a recirculation pipe 50 coupled with a supply connection 52. Recirculation pipe 50 and supply connection 52 preferably comprise transparent or translucent tubing or piping, such as transparent or translucent plastic pipe.

Recirculation pipe 50 includes an intake end 54 and a discharge end 56. Subject material or slurry can be pumped into recirculation pipe 50 via intake end 54. An intake valve 58 and an exhaust or discharge valve 60 are coupled with recirculation pipe 50 for controlling the flow of subject material. Plural sensors 26 are provided within sections of recirculation pipe 50 as shown. One of sensors 26 is vertically arranged with respect to a vertical pipe section 62. Another of sensors 26 is horizontally oriented with respect to a horizontal pipe section 64. Sensors 26 are configured to monitor the turbidity of subject material or slurry within vertical pipe section 62 and horizontal pipe section 64.

Individual sensors 26 configured to monitor horizontal pipe sections (e.g., pipe section 64) may be arranged to monitor a lower portion of the horizontal pipe for gravity settling of particulate matter. As described below, an optical axis of sensor 26 can be aimed to intersect a lower portion of horizontally arranged tubing or piping to provide the preferred monitoring. Such can assist with detection of precipitation of particulate matter which can form into large undesirable particles leading to defects. Accordingly, once a turbidity limit has been reached, the tubing or piping may be flushed.

Supply connection 52 is in fluid communication with horizontal pipe section 64. In addition, supply connection 52 is in fluid communication with process chamber 16 of semiconductor processor 12 shown in FIG. 1. Supply connection 52 is configured to supply subject material such as slurry to process chamber 16. A sensor 26 is provided adjacent supply connection 52. Sensor 26 is configured to monitor the turbidity of subject material within supply connection 52. Additionally, a supply valve 66 controls the flow of subject material within supply connection 52.

Although only one supply connection 52 is illustrated, it is understood that additional supply connections can be provided to couple associated semiconductor processors (not shown) with recirculation pipe 50 and distributor 14. The depicted supply connection 52 is arranged in a vertical orientation. Supply connection 52 with associated sensor 26 may also be provided in a horizontal or other orientation in other configurations.

Figure 4:
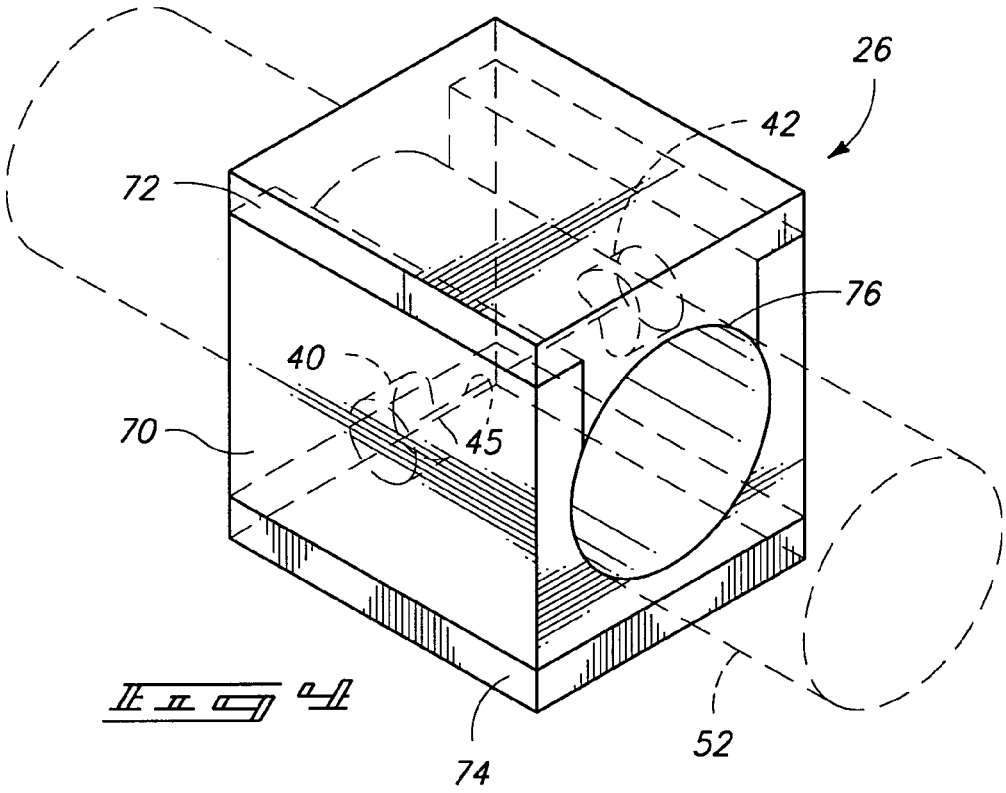
FIG. 4 is an isometric view of one configuration of a turbidity sensor.

Referring to FIG. 4, an exemplary configuration of sensor 26 is shown. The illustrated configuration of sensor 26 includes a housing 70, cover 72 and associated circuit board 74. The illustrated housing 70 is configured to couple with a conduit, such as supply connection 52. For example, housing 70 is arranged to receive supply connection 52 with a longitudinal orifice 76. Cover 72 is provided to substantially enclose supply connection 52. In a preferred arrangement, housing 70 and cover 72 are formed of a substantially opaque material.

Housing 70 is configured to provide source 40 and receiver 42 adjacent supply connection 52. More specifically, housing 70 is configured to align source 40 and receiver 42 with respect to supply connection 52 and any subject material such as slurry therein. In the depicted configuration, housing 70 aligns source 40 and receiver 42 to define an optical axis 45 which passes through supply connection 52.

The illustrated housing 70 is configured to allow attachment of sensor 26 to supply connection 52 or detachment of sensor 26 from supply connection 52 without disruption of the flow of subject material within supply connection 52. Housing 70 can be clipped onto supply connection 52 as illustrated or removed therefrom without disrupting the flow of subject material within supply connection 52 in the described embodiment.

Source 40 and receiver 42 may be coupled with circuit board 74 via internal connections (not shown). Further details regarding circuitry implemented within circuit board 74 are described below. The depicted sensor configuration provides sensor 26 capable of monitoring the turbidity of subject material within supply connection 52 without contacting and possibly contaminating the subject material or without disrupting the flow of subject material within supply connection 52.

More specifically, sensor 26 is substantially insulated from the subject material within supply connection 52 in the described arrangement. Accordingly, sensor 26 provides a non-intrusive device for monitoring the turbidity of subject material 80. Such is preferred in applications wherein contamination of subject material 80 is a concern. Utilization of sensor 26 does not impede or otherwise affect flow of the subject material.

In one configuration, source 40 comprises a light emitting diode (LED) configured to emit infrared electromagnetic energy. Source 40 is configured to emit electromagnetic energy of another wavelength in an alternative embodiment. Receiver 42 may be implemented as a photodiode in an exemplary embodiment. Receiver 42 is configured to receive electromagnetic energy emitted from source 40. Receiver 42 of sensor 26 is configured to generate a signal indicative of the turbidity of the subject material and output the signal to associated circuitry for processing or data logging.

Figure 5:
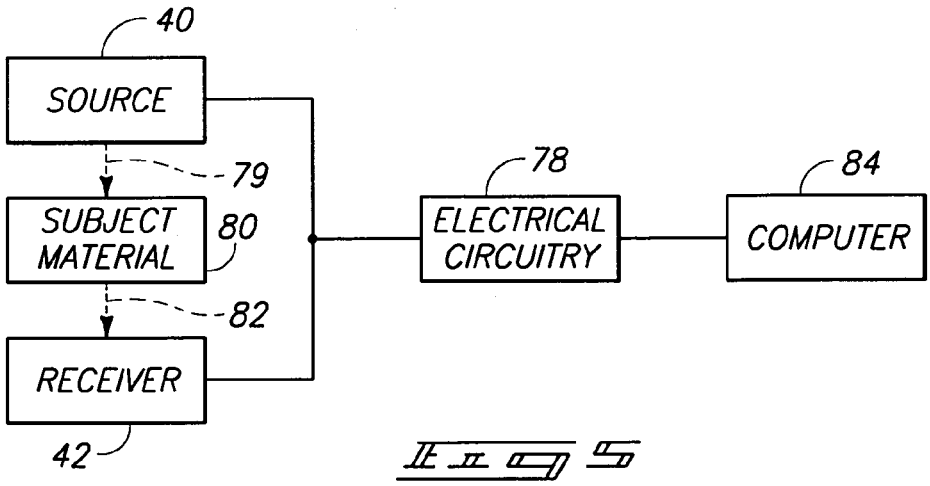
FIG. 5 is a cross-sectional view of another sensor configuration.

Referring to FIG. 5, source 40 and receiver 42 are coupled with electrical circuitry 78. In the illustrated embodiment, source 40 and receiver 42 are aimed towards one another. Source 40 is operable to emit electromagnetic energy 79 towards subject material 80. Particulate matter within subject material 80 operates to absorb some of the emitted electromagnetic energy 79. Accordingly, only a portion, indicated by reference 82, of the emitted electromagnetic energy 79 passes through subject material 80 and is received within receiver 42.

Electrical circuitry 78 is configured to control the emission of electromagnetic energy 79 from source 40 in the described configuration. Receiver 42 is configured to output a signal indicative of the received electromagnetic energy 82 corresponding to the intensity of the received electromagnetic energy. Electrical circuitry 78 receives the outputted signal and, in one embodiment, conditions the signal for application to an associated computer 84. In one embodiment, computer 84 is configured to compile a log of received information from receiver 42 of sensor 26.

Figure 6:
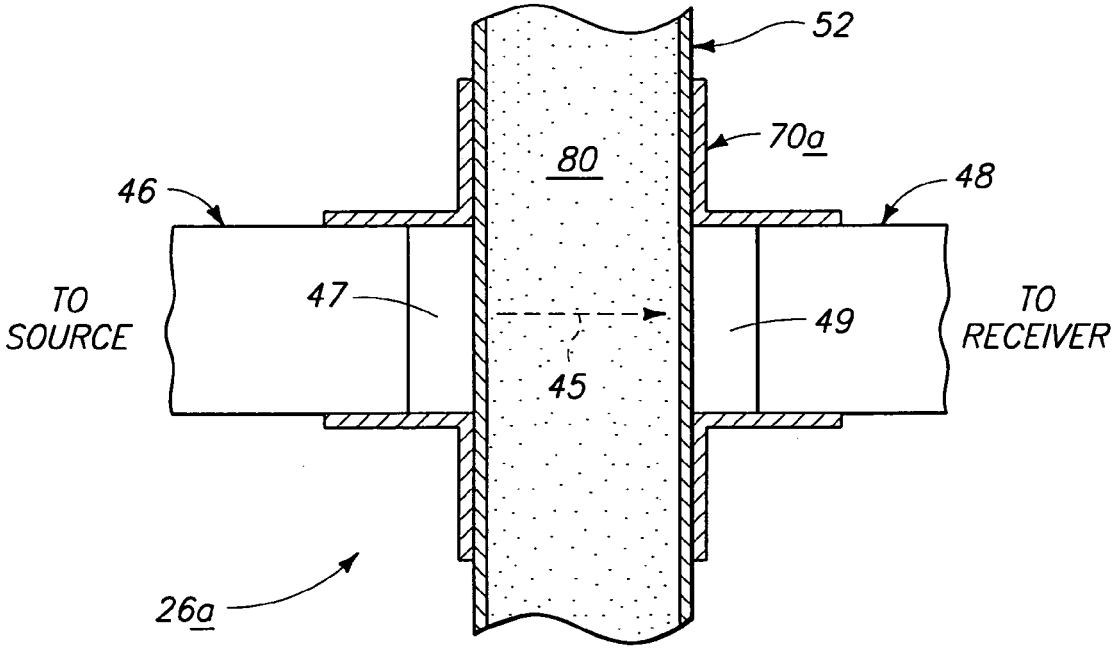
FIG. 6 is an illustrative representation of an exemplary arrangement of a source and receiver of a sensor.

Referring to FIG. 6, an alternative sensor arrangement indicated by reference 26*a* is shown. In the depicted embodiment, an alternative housing 70*a* is implemented as a cross fitting 44 utilized to align the source and receiver of sensor 26*a* with supply connection 52. Supply connection 52 is aligned along one axis of cross fitting 44.

In the depicted configuration, light-carrying cable or light pipe, such as fiberoptic cable, is utilized to couple a remotely located source and receiver with supply connection 52. A first fiberoptic cable 46 provides electromagnetic energy emitted from source 42 to supply connection 52. A lens 47 is provided flush against supply connection 52 and is configured to emit the electromagnetic light energy from cable 46 towards supply connection 52 along optical axis 45 perpendicular to the axis of supply connection 52. Electromagnetic energy which is not absorbed by subject material 80 is received within a lens 49 coupled with a second fiberoptic cable 48. Fiberoptic cable 48 transfers the received light energy to receiver 42. Sensor arrangement 26*a* can include appropriate seals, bushings, etc., although such is not shown in FIG. 6.

As previously mentioned, supply connection 52 is preferably transparent to pass as much electromagnetic light energy as possible. Supply connection 52 is translucent in an alternative arrangement. Lenses 47, 49 are preferably associated with supply connection 52 to provide maximum transfer of electromagnetic energy. In other embodiments, lenses 47, 49 are omitted. Further alternatively, the source and receiver of sensor 26 may be positioned within housing 70*a* in place of lenses 47, 49. Fiberoptic cables 46, 48 could be removed in such an embodiment.

Figure 7:
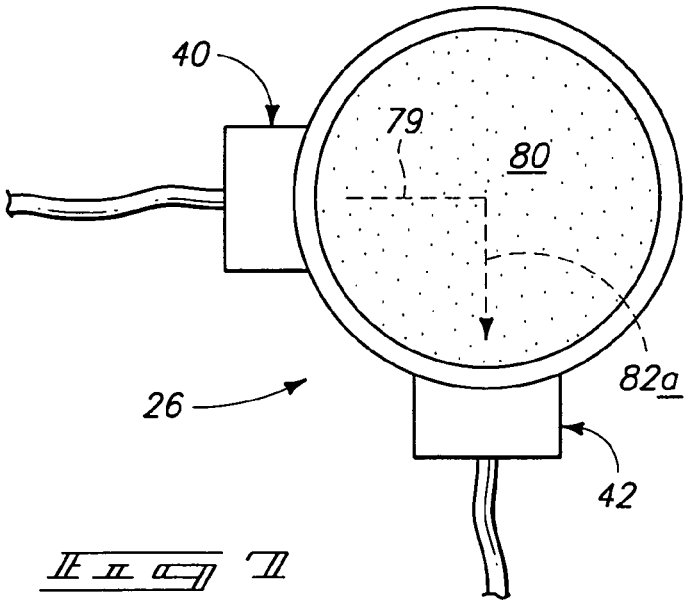
FIG. 7 is a functional block diagram illustrating components of an exemplary sensor and associated circuitry.

Referring to FIG. 7, another implementation of sensor 26 is shown. Source 40 and receiver 42 are arranged at a substantially 90° angle in the depicted configuration. Source 40 operates to emit electromagnetic energy 79 into supply connection 52 and subject material 80 within supply connection 52. As previously stated, subject material 80 can contain particulate matter which may operate to reflect light. Receiver 42 is positioned in the depicted arrangement to receive such reflected light 82*a*. Associated electrical circuitry coupled with source 40 and receiver 42 can be calibrated to provide accurate turbidity information responsive to the reception of reflected light 82*a*. Although source 40 and receiver 42 are illustrated at a 90° angle in the depicted arrangement, source 40 and receiver 42 may be arranged at any other angular relationship with respect to one another and supply connection 52 to provide emission of electromagnetic energy 79 and reception of reflected electromagnetic energy 82*a*.

Figure 8:
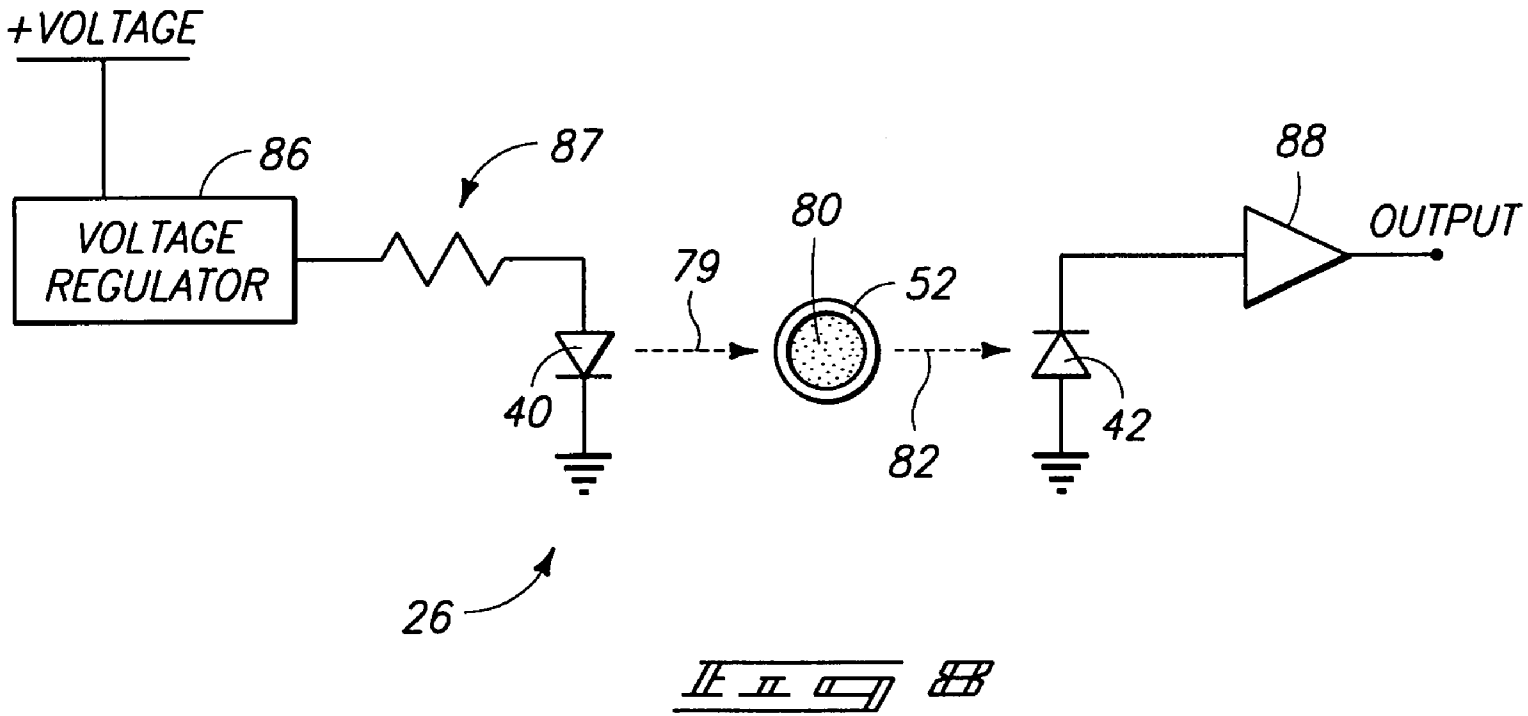
FIG. 8 is a schematic diagram of an exemplary sensor configuration.
Figure 5:
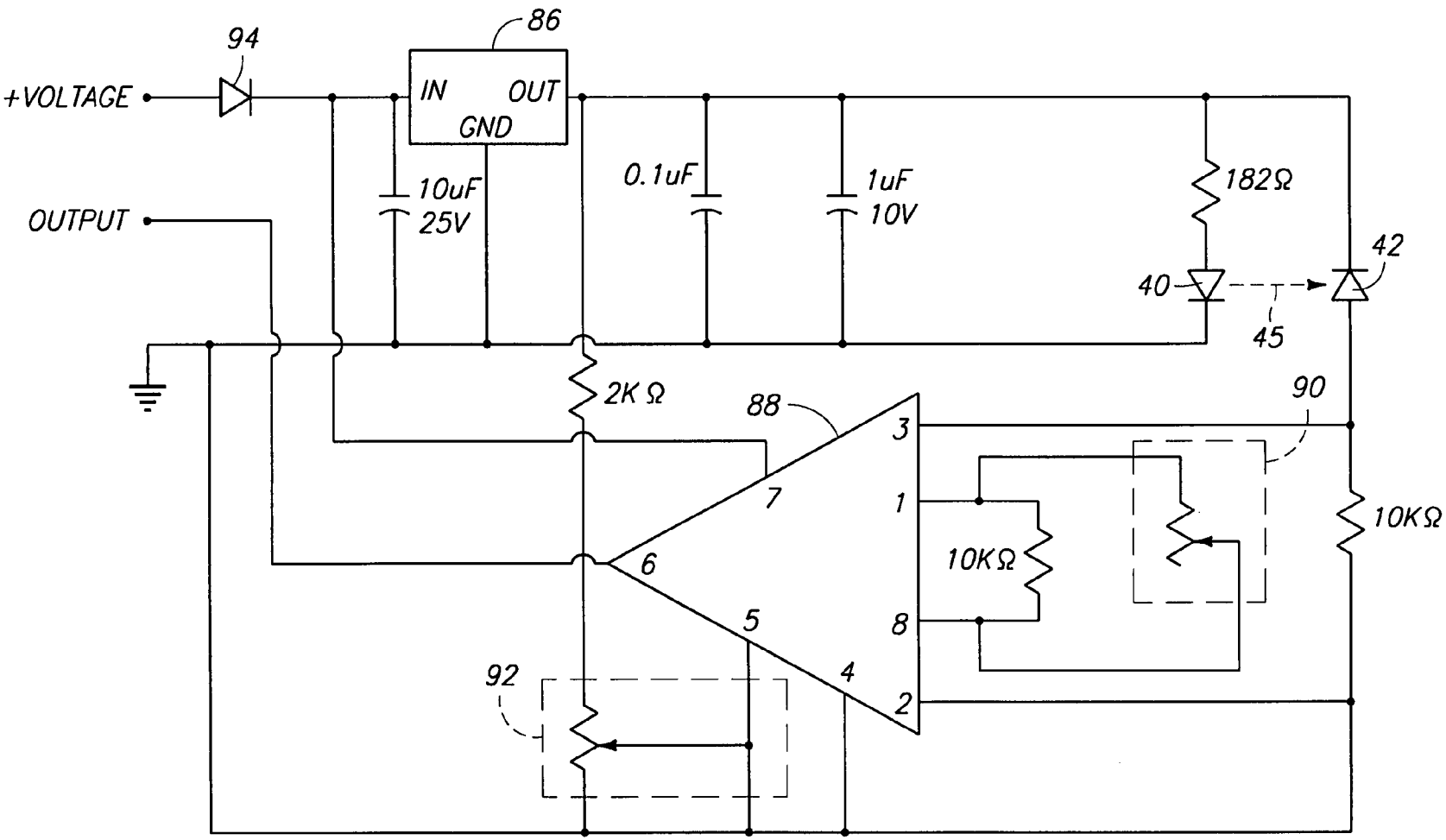

Referring to FIG. 8, one arrangement of sensor 26 for providing turbidity information of subject material 80 is shown. Source 40 is implemented as a light emitting diode (LED) configured to emit infrared electromagnetic energy 79 towards supply connection 52 having subject material 80 in the depicted arrangement. A positive voltage bias may be applied to a voltage regulator 86 configured to output a constant supply voltage. For example, the positive voltage bias can be a 12 Volt DC voltage bias and voltage regulator 86 can be configured to provide a 5 Volt DC reference voltage to light emitting diode source 40.

Source 40 emits electromagnetic energy of a known intensity responsive to an applied current from dropping resistor 87. Receiver 42 comprises a photodiode in an exemplary embodiment configured to receive light electromagnetic energy 82 not absorbed within subject material 80. Photodiode receiver 42 is coupled with an amplifier 88 in the depicted configuration. Amplifier 88 is configured to provide an amplified output signal indicating the turbidity of subject material 80. Other configurations of source 40 and receiver 42 are possible.

Referring to FIG. 9, additional details of the arrangement shown in FIG. 8 are illustrated. Source 40 is implemented as a light emitting diode (LED). Receiver 42 comprises a photodiode. A potentiometer 90 is coupled with a pin 1 and a pin 8 of amplifier 88 and can be varied to provide adjustment of the gain of amplifier 88. An exemplary variable base resistance of potentiometer 90 is 100 Ωk. Another potentiometer 92 is coupled with a pin 5 of amplifier 88 and is configured to provide calibration of sensor 26. Potentiometer 92 may be varied to provide an offset of the output reference of amplifier 88. An exemplary variable base resistance of potentiometer 92 is 500 Ω.

A positive voltage reference bias is applied to a diode 94. An exemplary positive voltage is approximately 12–24 Volts DC. Voltage regulator 86 receives the input voltage and provides a reference voltage of 5 Volts DC in the described embodiment.

Figure 10:
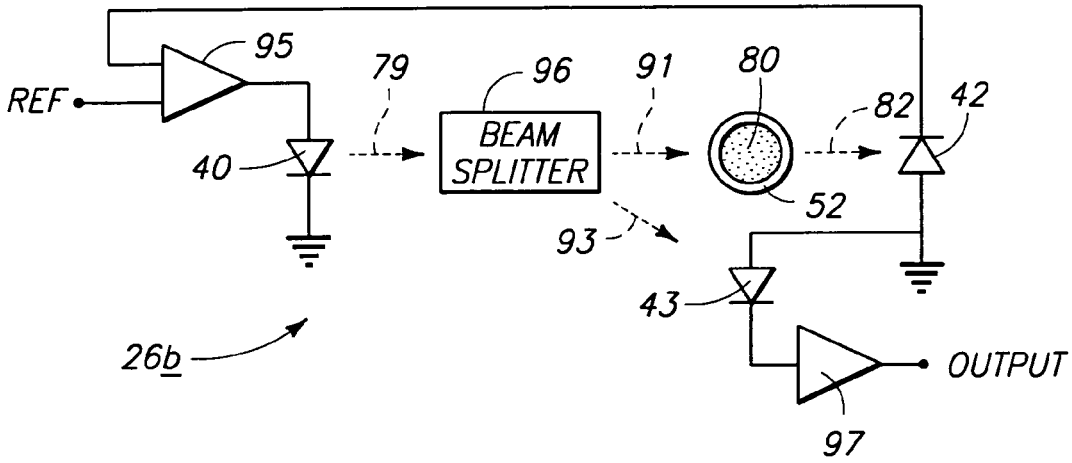
FIG. 10 is a schematic diagram of another exemplary sensor configuration.

Referring to FIG. 10, an alternative sensor configuration is illustrated as reference 26*b*. The illustrated sensor configuration includes a driver 95 coupled with source 40. Additionally, a beam splitter 96 is provided intermediate source 40 and supply connection 52. Further, an additional receiver 43 and associated amplifier 97 are provided as illustrated.

A reference voltage is applied to driver 95 during operation. Source 40 is operable to emit electromagnetic energy 79 towards beam splitter 96. Beam splitter 96 directs received electromagnetic energy into a beam 91 towards supply connection 52 and a beam 93 towards receiver 43. Receiver 42 is positioned to receive non-absorbed electromagnetic energy 91 passing through supply connection 52 and subject material 80. Receiver 42 is configured to generate and output a feedback signal to driver 95. The feedback signal is indicative of the electromagnetic energy 91 received within receiver 42.

The depicted sensor 26*b* is configured to provide a substantially constant amount of light electromagnetic energy to receiver 42. Driver 95 is configured to control the amount or intensity of emitted electromagnetic energy from source 40. More specifically, driver 95 is configured in the described embodiment to increase or decrease the amount of electromagnetic energy 79 emitted from source 40 responsive to the feedback signal from receiver 42.

Receiver 43 is positioned to receive the emitted electromagnetic energy directed from beam splitter 96 along beam 93. Receiver 43 receives electromagnetic energy not passing through subject material 80 in the depicted embodiment. The output of receiver 43 is applied to amplifier 97 which provides a signal indicative of the turbidity of subject material 80 within supply connection 52 responsive to the intensity of electromagnetic energy of beam 93.

Figure 11:
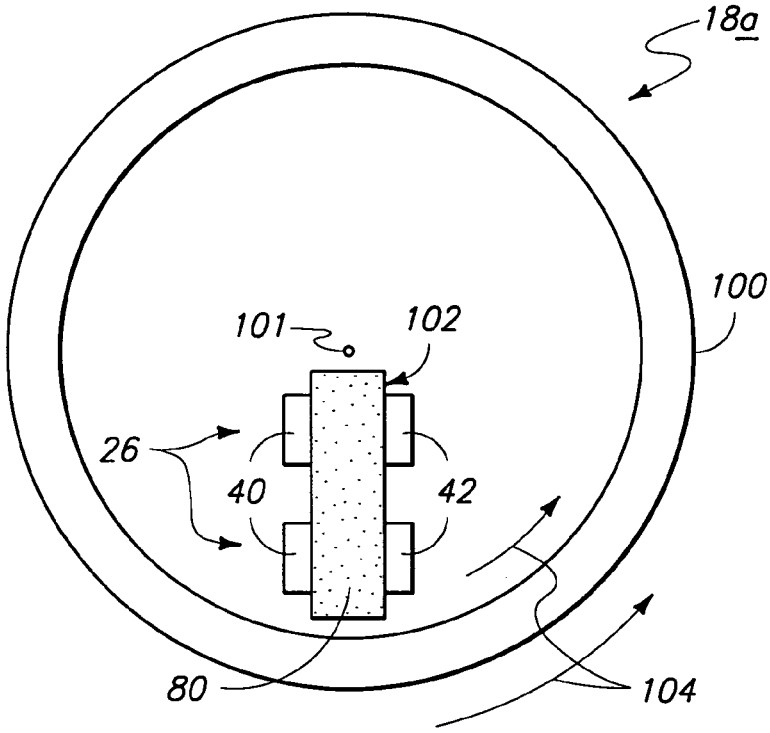
FIG. 11 is an illustrative representation of a sensor implemented in a centrifuge application.

Referring to FIG. 11, an exemplary alternative configuration for analyzing slurry in a substantially static state is shown. The illustrated static route 18*a* comprises a centrifuge 100. The depicted centrifuge 100 includes a container 102 configured to receive subject material 80. Plural sensors 26 are provided at predefined positions along container 102 to monitor the turbidity of subject material 80 at different radial positions. Centrifuge 100 including container 102 is configured to rapidly rotate in the direction indicated by arrows 104 about axis 101 to assist with precipitation of particulate matter within subject material 80. Such provides increased setting rates of the particulate matter. Sensors 26 can individually provide turbidity information of subject material 80 at the predefined positions of sensors 26 relative to container 102. Such information can indicate the state or condition of the slurry as previously discussed. Centrifuge 100 can be configured to receive samples of slurry or other subject material during operation of semiconductor workpiece system 10. Information from sensors 26 can be accessed via rotary couplings or wireless configurations during rotation of container 102 in exemplary embodiments.

From the foregoing, it is apparent the present invention provides a sensor which can be utilized to monitor turbidity of a nearly opaque fluid. Further, the disclosed sensor configurations have a wide dynamic range, are nonintrusive and have no wetted parts. In addition, the sensors of the present invention are cost effective when compared with other devices, such as densitometers.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A turbidity monitoring method comprising:

providing a source;

emitting electromagnetic energy towards subject material using the source;

aligning an initial receiver relative to the subject material;

first receiving at least some of the electromagnetic energy after the emitting using the initial receiver;

generating a signal indicative of the turbidity responsive to the first receiving;

second receiving at least some of the electromagnetic energy passing through the subject material using another receiver; and controlling the emitting responsive to the second receiving to provide a substantially constant amount of received electromagnetic energy at the another receiver.

2. The method according to claim 1 wherein the emitting comprises emitting infrared electromagnetic energy.

3. The method according to claim 1 further comprising directing the emitted electromagnetic energy to the initial receiver and the another receiver.

4. The method according to claim 1 wherein the first receiving the at least some of the electromagnetic energy using the initial receiver comprises receiving electromagnetic energy not passing through the subject material.

5. A sensor comprising:

a source configured to emit electromagnetic energy towards a subject material;

an initial receiver configured to receive at least some of the electromagnetic energy, the initial receiver being configured to generate a signal indicative of the turbidity of the subject material and responsive to the received electromagnetic energy; and wherein the initial receiver is configured to receive the emitted electromagnetic energy without passage of the electromagnetic energy through the subject material.

6. The sensor according to claim 5 wherein the source comprises a light emitting diode.

7. The sensor according to claim 6 wherein the light emitting diode is configured to emit infrared electromagnetic energy.

8. The sensor according to claim 5 further comprising:

another receiver configured to receive at least some of the electromagnetic energy passing through the subject material and to generate a signal indicative of the received electromagnetic energy; and a driver configured to control the amount of emitted electromagnetic energy from the source to provide a substantially constant amount of received electromagnetic energy at the another receiver.

9. The sensor according to claim 5 further comprising a beam splitter configured to direct electromagnetic energy from the source to the subject material and to the initial receiver.

10. The sensor according to claim 5 further comprising another receiver configured to receive reflected electromagnetic energy from the subject material.

11. The sensor according to claim 5 further comprising a housing configured to align the source with respect to the subject material, and wherein the housing is configured to attach to a supply connection containing the subject material and detach from the supply connection without disruption of the flow of subject material within the supply connection.

12. The sensor according to claim 5 wherein the initial receiver is configured to generate the signal responsive to the at least some of the electromagnetic energy being received without passage through the subject material.

13. The sensor according to claim 8 further comprising a housing configured to align the source and the another receiver with respect to the subject material.

14. The sensor according to claim 8 wherein the driver is configured to receive the signal generated by the another receiver, and to control the amount of emitted electromagnetic energy responsive to the signal.

15. A turbidity monitoring method comprising:

emitting electromagnetic energy towards a subject material;

first receiving at least some of the emitted electromagnetic energy;

generating a signal indicative of turbidity responsive to the first receiving;

second receiving other of the emitted electromagnetic energy passing through the subject material; and controlling the emitting responsive to the second receiving to provide a substantially constant amount of received emitted electromagnetic energy during the second receiving.

16. The method according to claim 15 wherein the first receiving comprises receiving the at least some of the electromagnetic energy not passing through the subject material.

17. The method according to claim 15 wherein the first receiving comprises receiving using a first receiver and the second receiving comprises receiving using a second receiver.

18. The method according to claim 15 further comprising providing another signal indicative of the other of the electromagnetic energy received during the second receiving, and wherein the controlling is responsive to the another signal.

19. The method according to claim 1 further comprising providing a signal indicative of the at least some electromagnetic energy received using the another receiver, and wherein the controlling is responsive to the signal.

20. The method according to claim 1 wherein the aligning comprises aligning the initial receiver to receive the at least some of the electromagnetic energy not passing through the subject material.

* * * * *